US005258351A

United States Patent [19]

Satake et al.

[11] Patent Number: 5,258,351

[45] Date of Patent: Nov. 2, 1993

[54] ELECTROTHERMAL TRANSFER SHEET

[75] Inventors: Naoto Satake; Tatsuya Kita, both of Tokyo, Japan

[73] Assignee: Dai Nippon Insatsu Kabushiki Kaisha, Japan

[21] Appl. No.: 674,748

[22] Filed: Mar. 26, 1991

[30] Foreign Application Priority Data

Mar. 30, 1990 [JP] Japan ..... 2-83074
Mar. 30, 1990 [JP] Japan ..... 2-83075

[51] Int. Cl.[5] ..... B41M 5/035; B41M 5/38

[52] U.S. Cl. ..... 503/227; 428/195; 428/913; 428/914

[58] Field of Search ..... 8/471; 428/195, 488.4, 428/913, 914; 503/227

[56] References Cited

U.S. PATENT DOCUMENTS 4,684,563 8/1987 Hayashi et al. ..... 428/207
4,975,332 12/1990 Shini et al. ..... 428/500

*Primary Examiner*—B. Hamilton Hess
*Attorney, Agent, or Firm*—Parkhurst, Wendel & Rossi

[57] ABSTRACT

An electrothermal transfer sheet including (i) a resistor sheet, and (ii) a dye layer formed on one surface of the resistor layer, comprising a heat-transferable dye and a binder, the resistor layer being prepared by subjecting a film which includes (a) an electroconductive material, and (b) a resin composition containing a polymer and a monomer to a crosslinking reaction, the amount of the monomer being from 10 to 150 parts by weight per 100 parts by weight of the polymer, the crosslinking reaction being caused by applying ionizing radiation to the film; and an electrothermal transfer sheet including (i) a substrate sheet, (ii) a dye layer formed on one surface of the substrate sheet, including a heat-transferable dye and a binder, and (iii) a resistor layer formed on the other surface of the substrate sheet, the resistor layer being prepared by subjecting a film which includes (a) an electroconductive material, and (b) a resin composition containing a polymer and a monomer to a crosslinking reaction, the amount of the monomer being from 10 to 150 parts by weight per 100 parts by weight of the polymer, the crosslinking reaction being caused by applying ionizing radiation to the film.

10 Claims, No Drawings

ELECTROTHERMAL TRANSFER SHEET

BACKGROUND OF THE INVENTION

This invention relates to an electrothermal transfer sheet, and more particularly to a thermal transfer sheet for use with an electrothermal transfer printing method.

An electrothermal transfer printing method is a method in which printing is carried out by utilizing heat which is generated when an electric current is applied by an electrode head. With this printing method, an electrothermal transfer sheet comprising a substrate sheet, a resistor layer formed on one surface of the substrate sheet, capable of generating heat when an electric current is applied thereto by an electrode head, and a dye layer formed on the other surface of the substrate sheet, comprising a dye, such as a sublimable dye, transferable to an image-receiving sheet upon application of heat; and an electrothermal transfer sheet whose substrate sheet itself has electroconductivity and can serve as a resistor layer have been conventionally used. In particular, the latter transfer sheet has improved thermal sensitivity.

A film of a thermoplastic resin such as polyethyleneterephthalate is used as the substrate sheet and/or the resistor layer of the above-described conventional electrothermal transfer sheets. To conduct electrothermal transfer printing, an electrode head is used, as a heat-application means, to apply an electric current to the transfer sheet so as to directly generate heat in its resistor layer. Although thermal energy can thus be effectively utilized when printing is carried out by this printing method, the generated heat tends to partially accumulate in the electrothermal transfer sheet. The electrothermal transfer printing method brings about such partial accumulation of heat much easier than the printing method which employs a thermal head as a heat-application means. Since the thermoplastic resins which are used for the substrate sheet and/or resistor layer of the conventional electrothermal transfer sheets have low heat resistance, the conventional transfer sheets cannot fully endure the practical electrothermal transfer printing.

In other words, the conventional electrothermal transfer sheets cannot exhibit sufficient mechanical strength when heated, and suffer from problems of crumpling and breaking when printing is carried out. Moreover, the resistor layer and the substrate sheet are fused by the partially accumulated heat, and the fused material sticks to the surface of an electrode head to cause a short circuit. As a result, the electrode head partially generates an excessively high temperature of heat. Because of this heat generated, the resistor layer fuses and sticks to the electrode head, causing various problems; for instance, the electrode head cannot run smoothly when printing is carried out, and an image cannot be normally obtained.

SUMMARY OF THE INVENTION

Accordingly, an object of the present invention is to provide an electrothermal transfer sheet which can overcome the aforementioned drawbacks resided in the prior art, and more specifically an electrothermal transfer sheet which has high heat resistance, exhibits high mechanical strength even when heated, does not cause sticking between its substrate sheet or resistor layer and an electrode head when printing is carried out, and ensures smooth running of the electrode head and normal printing.

The foregoing object of the present invention can be accomplished by an electrothermal transfer sheet comprising a resistor sheet (electroconductive heat-generating sheet), and a dye layer formed on one surface of the resistor sheet, comprising a heat-transferable dye and a binder, the resistor layer being prepared by subjecting a film comprising (a) an electroconductive material, and (b) a resin composition containing a polymer and a monomer to a crosslinking reaction, the amount of the monomer being from 10 to 150 parts by weight per 100 parts by weight of the polymer, the crosslinking reaction being caused by applying ionizing radiation to the film.

As described above, the electrothermal transfer sheet according to the above first embodiment of the present invention comprises a resistor sheet which also serves as a substrate sheet and the resistor layer is prepared by subjecting a film comprising (a) an electroconductive material, and (b) a resin composition containing a specific amount of monomer to a crosslinking reaction which is caused by applying ionizing radiation to the film. Therefore, the resistor layer has high heat resistance, and can fully endure electrothermal transfer printing. In other words, the electrothermal transfer sheet is not thermally fused to stick to an electrode head when printing is carried out, and can ensure smooth running of the electrode and normal printing. The heat resistance of the electrothermal transfer sheet can be further enhanced, and smooth running of the electrode is more securely attained when the resin composition comprised in the film for forming the resistor layer contains two or more kinds of monomer.

The object of the present invention can also be attained by an electrothermal transfer sheet comprising (i) a substrate sheet, (ii) a dye layer formed on one surface of the substrate sheet, comprising a heat-transferable dye and a binder, and (iii) a resistor layer formed on the other surface of the substrate sheet, the resistor layer being prepared by subjecting a film comprising (a) an electroconductive material, and (b) a resin composition containing a polymer and a monomer to a crosslinking reaction, the amount of the monomer being from 10 to 150 parts by weight per 100 parts by weight of the polymer, the crosslinking reaction being caused by applying ionizing radiation to the film.

Since the resistor layer of the electrothermal transfer sheet according to the above second embodiment of the present invention is prepared by subjecting a film comprising (a) an electroconductive material, and (b) a resin composition containing a specific amount of monomer to a crosslinking reaction which is caused by applying ionizing radiation, it has sufficiently high heat resistance and good film properties. Therefore, the electrothermal transfer sheet is not thermally fused to stick to an electrode head, and can ensure both smooth running of the electrode head and normal printing upon conducting electrothermal transfer printing. In addition to the heat resistance and the film properties, adhesion between the resistor layer and the substrate sheet can also be increased when the resin composition comprised in the film for forming the resistor layer contains two or more kinds of monomer.

DETAILED DESCRIPTION OF THE PREFERRED EMBODIMENTS

The present invention will now be explained with reference to preferred embodiments.

The electrothermal transfer printing sheet according to the first embodiment of the present invention comprises a resistor sheet, and a dye layer formed on one surface thereof, and such a construction is the same as that of conventional electrothermal transfer printing sheets. However, the electrothermal transfer printing sheet of the first embodiment of the invention is distinguishable over conventional ones in that the resistor layer is prepared by subjecting a film comprising (a) an electroconductive material, and (b) a resin composition containing a polymer and a specific amount of monomer to a crosslinking reaction which is caused by applying ionizing radiation to the film. The amount of the monomer is from 10 to 150 parts by weight for 100 parts by weight of the polymer.

Examples of the polymer contained in the above resin composition include resins having relatively high heat resistance, such as polyester resins, polyacrylate resins, styrene-acrylate resins, polyurethane resins, polyolefin resins, polystyrene resins, polyvinyl chloride resins, polyether resins, polyamide resins, polyvinyl acetate resins, polycarbonate resins, polyether ketone resins, polyether sulfone resins, and polysulfide resins.

The monomer contained in the resin composition can increase the crosslinking density in the resistor layer, and also enhances heat resistance of the resistor layer. The resulting resistor layer can thus exhibit high mechanical strength even when heated.

Examples of the monomer preferably usable in the first embodiment of the invention include monomers having two functional groups such as tetraethyleneglycol diacrylate, tetraethyleneglycol dimethacrylate, divinylbenzene and diallyl phthalate, monomers having three functional groups such as triallyl isocyanurate, trimethylolpropane triacrylate, trimethylolpropane trimethacrylate, and monomers having four functional groups such as tetramethylolmethane tetraacrylate, tetramethylolmethane tetramethacrylate and trimethoxyvinyl silane. In addition to the above monomers, oligomers and macromers containing the above monomers are also usable.

In the first embodiment of the present invention, it is preferable to use two or more kinds of monomer selected from the above monomers in combination. In particular, a combination use of a monomer having two or less functional groups (hereinafter referred to as "first monomer") and a monomer having three or more functional groups (hereinafter referred to as "second monomer") is desirable.

Examples of the first monomer include monomers such as methacrylate, acrylate, dimethacrylate, diacrylate, divinylbenzene and diallyl phthalate, derivatives of these monomers, and oligomers and macromers containing these monomers. Of these, the following monomers are preferably employed:

(1) Methacrylate

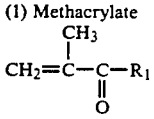

Wherein $R_1$ is —OH,

-continued $-(OC_2H_4)_n-OCH_3$ ($0 \leqq n \leqq 15$),
$-OC_nH_{2n+1}$ ($1 \leqq n \leqq 20$),
$-OC_2H_4-OOC-C_2H_4-COOH$,
$-OC_nH_{2n}(OH)$ ($1 \leqq n \leqq 20$),
$-OCH_2-CH(OH)-CH_2Cl$,
$-OC_2H_4(C_nH_{2n+1})_2$ ($1 \leqq n \leqq 20$),

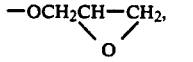

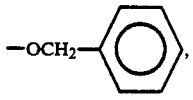

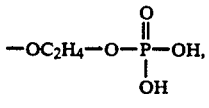

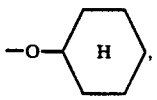

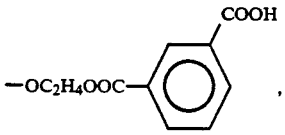

, or

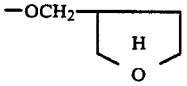

(2) Acrylate

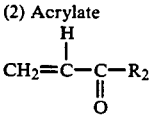

Wherein $R_2$ is
$-OC_nH_{2n+1}$ ($1 \leqq n \leqq 20$),
$-(OC_2H_4)_n-OC_mH_{2m+1}$ ($1 \leqq n \leqq 20$), ($1 \leqq m \leqq 20$),
$-OC_2H_4-OOC-C_2H_4-COOH$,
$-O-(CH_2CHCH_3O)_2-CH_3$
$-OC_nH_{2n}(OH)$ ($1 \leqq n \leqq 20$),
$-(OC_2H_4)_n-OCH_2CH_2H_5-C_4H_9$ ($1 \leqq n \leqq 15$),
$-O-(C_nH_{2n}COO)_m-H$ ($1 \leqq n \leqq 15$), ($1 \leqq m \leqq 10$),

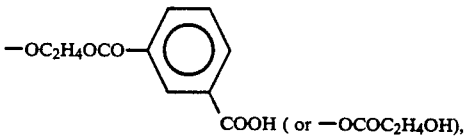

COOH ( or $-OCOC_2H_4OH$),

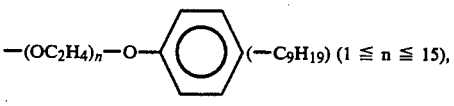

($-C_9H_{19}$) ($1 \leqq n \leqq 15$),

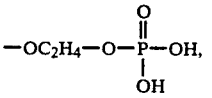

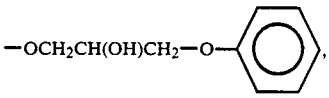

-continued

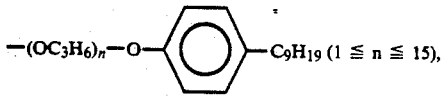

$-(OC_3H_6)_n-O-$ $-C_9H_{19}$ ($1 \leqq n \leqq 15$),

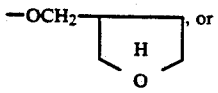

$-OCH_2-$ , or

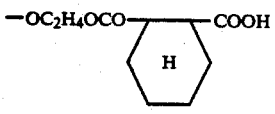

$-OC_2H_4OCO-$ $-COOH$ (3) Dimethacrylate

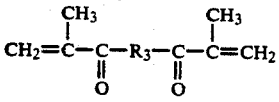

Wherein $R_3$ is
$-O-(C_2H_4)_n-$ ($1 \leqq n \leqq 10$),
$-O-(C_nH_{2n})-O-$ ($1 \leqq n \leqq 5$),
$-OCH_2CH(OH)CH_2O-$,

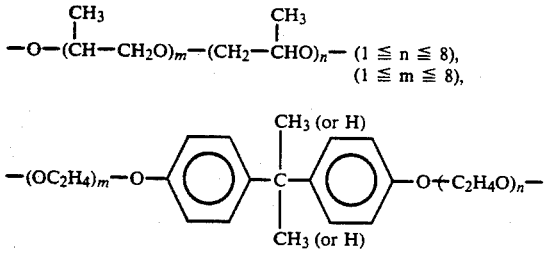

$-O-(CH(CH_3)-CH_2O)_m-(CH_2-CH(CH_3)O)_n-$ ($1 \leqq n \leqq 8$), ($1 \leqq m \leqq 8$), $-(OC_2H_4)_m-O-$ $C(CH_3)(CH_3)$ $-O-(C_2H_4O)_n-$ ($1 \leqq n \leqq 8$) ($1 \leqq m \leqq 8$)

(4) Diacrylate

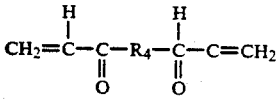

Wherein $R_4$ is the same as the above $R_3$, or

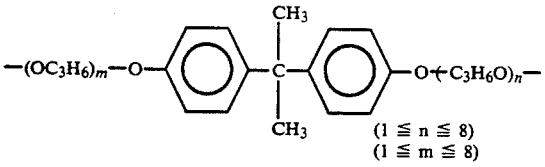

$-(OC_3H_6)_m-O-$ $C(CH_3)(CH_3)$ $-O-(C_3H_6O)_n-$ ($1 \leqq n \leqq 8$) ($1 \leqq m \leqq 8$)

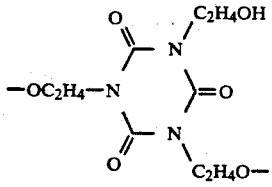

(5) Divinylbenzene

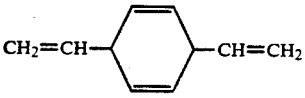

(6) Diallyl phthalate

-continued

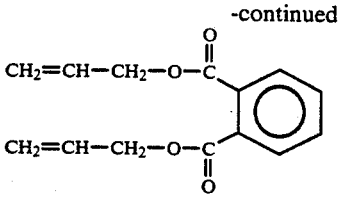

Examples of the second monomer for use in the first embodiment of the invention include monomers such as trimethacrylate, triacrylate, triallyl isocyanurate, tetraacrylate, pentaacrylate and hexaacrylate, derivatives of these monomers, and oligomers and macromers containing these monomers. Of these, the following specific monomers are preferably employed:

(1) Trimethacrylate

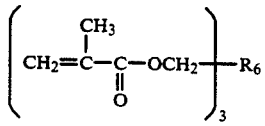

wherein $R_6$ is $-CCH_2CH_3$, (2) Triacrylate

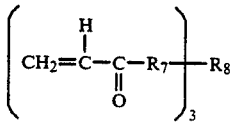

wherein $R_7$ is $-O-CH_2-$,
$-(OC_2H_4)_2-OCH_2-$,
$-(OC_3H_6)_n-OCH_2-$ ($1 \leqq n \leqq 20$),
$-OC_2H_4-$, or
$-O-(CH_2)_n-OCOC_2H_4-$ ($1 \leqq n \leqq 20$), $R_8$ is $-CCH_2CH_3$,
$-CCH_2OH$, or

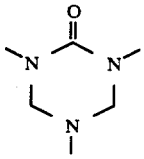

(3) Triallyl isocyanurate

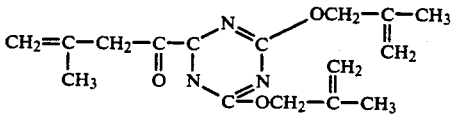

(4) Tetraacrylate

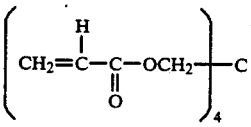

(5) Pentaacrylate

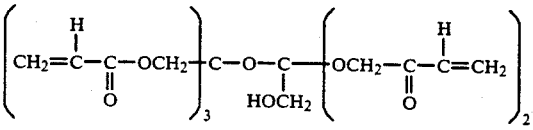

-continued (6) Hexaacrylate

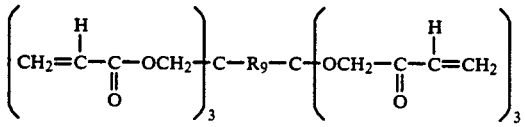

wherein $R_9$ is —O— or —$CH_2O$—$CH_2$—

The total amount of the above monomers is from 10 to 150 parts by weight, preferably from 40 to 130 parts by weight, per 100 parts by weight of the polymer contained in the resin composition. In the case where the amount of the monomer is less than 10 parts by weight per 100 parts by weight of the polymer, the resulting resistor sheet has low heat resistance and exhibits low mechanical strength when heated. As a result, the resistor sheet is thermally fused to stick to an electrode head, and causes problems of a short circuit and breaking of the transfer sheet when printing is carried out. When the amount of the monomer is more than 150 parts by weight, the resistor sheet has high crosslinking density and high heat resistance, so that it exhibits high mechanical strength even when heated, but cannot have proper flexibility.

In the first embodiment of the invention, as described above, it is preferable to use the first monomer having two or less functional groups, and the second monomer having three or more functional groups in combination. In this case, the .amount of the first monomer is from 20 to 80 wt. %, preferably from 40 to 70 wt. %, of the total amount of the first and second monomers, while the amount of the second monomer is from 80 to 20 wt. %, preferably from 30 to 60 wt. %, of the total amount of the first and second monomers. When the amount of the first monomer is more than 80 wt. % of the total amount of the monomers, the resistor sheet has low heat resistance, and exhibits low mechanical strength when heated. As a result, the resistor layer tends to thermally fuse and to stick to an electrode head, or to be broken when printing is carried out. When the amount of the second monomer is more than 80 wt. %, the resistor sheet has high heat resistance, and exhibits high mechanical strength even when heated. However, flexibility of the resistor sheet is reduced, and the properties of the electrothermal transfer sheet comprising such a resistor sheet are impaired.

In summary, when the first monomer and the second monomer are used in the above-described proportion, the resistor sheet has high heat resistance and high flexibility, and exhibits high mechanical strength even when heated. Therefore, the resistor sheet is free from fusion, crumpling and breaking when printing is conducted, and a high-quality image can thus be obtained.

Metal powder or a metal oxide may be used as the electroconductive material to be contained in the film for forming the resistor sheet. However, carbon black such as furnace black, acetylene black, ketene black, channel black or thermal black is preferably employed as the electroconductive material in the first embodiment of the invention.

When a small amount of the electroconductive material is incorporated into the film for forming the resistor sheet, the resistor sheet cannot have sufficiently high electroconductivity. On the other hand, when an excessively large amount of the electroconductive material is incorporated, the relative amount of the resin composition contained in the film becomes small, and the film properties of the resulting resistor sheet deteriorate. As a result, sufficiently high adhesion between the resistor sheet and the substrate sheet cannot be obtained, and scum tends to stick to an electrode head when printing is carried out.

When all the above matters are taken into consideration, it is preferable that the amount of the electroconductive material be 300 parts by weight or less, preferably from 40 to 200 parts by weight, per 100 parts by weight of the resin composition containing the monomers.

The resistor sheet of the first embodiment of the invention can be prepared in accordance with the following manner:

The above-described monomers, polymer, and carbon black as the electroconductive material, and other auxiliary materials are thoroughly mixed. The resulting mixture is processed to a film by an ordinary method for forming a resinous film, such as melt casting, an inflation method, an extrusion method such as a T-die method, or calendering. In the case of an extrusion method, either monoaxial or biaxial drawing is applicable.

The above-obtained film is hardened by subjecting it to a crosslinking reaction. The reaction is caused by applying ionizing radiation, such as an ultraviolet ray or an electron beam, to the film.

In the case where an ultraviolet ray, which may be obtained by any known ultraviolet-generating apparatus, is used for hardening the film, it is preferable to add proper additives, such as a photosensitizer, a polymerization initiator and a radical generator, to the mixture of the polymer, monomer and electroconductive material in advance. However, when an electron beam, which may be obtained by any known electron-beam-generator, is employed, it is not necessary to add the above-mentioned additives to the mixture for forming the resistor sheet. An electron beam is more desirable than an ultraviolet ray because permeability of an electron beam is higher than that of an ultraviolet ray.

The thickness of the resistor sheet is generally from 3 to 50 μm, preferably from 5 to 20 μm.

The resistor layer may further comprise a slippery agent. Such a resistor sheet has improved smoothening properties.

Furthermore, it is preferable that the resistor sheet have a surface resistivity of from 500 Ω/□ to 5 kΩ/□.

In the first embodiment of the invention, there is no limitation on the heat-transferable dye (sublimable dye) to be incorporated into the dye layer, which is provided on one surface of the resistor layer, and any known dye usable in conventional electrothermal transfer sheets can be employed. Preferable examples of the dye include MS Red G, Macrolex Red Violet R, Ceres Red 7B, Samaron Red HBSL and Resolin Red F3BS as red dyes; Phorone Brilliant Yellow 6GL, PTY-52 and Macrolex Yellow as yellow dyes; and Kayaset Blue 714, Waxolin Blue AP-FW, Phorone Brilliant Blue S-R and MS Blue 100 as blue dyes.

Examples of the binder which is used along with the dye in the dye layer include cellulose resins such as ethyl cellulose, hydroxyethyl cellulose, ethylhydroxyl cellulose, hydroxypropyl cellulose, methyl cellulose, cellulose acetate and cellulose butyrate, vinyl resins such as polyvinyl alcohol, polyvinyl acetate and polyvinyl pyrrolidone, acrylic resins such as polyacrylate, polymethacrylate, polyacrylamide and polymethacrylamide, polyurethane resins, polyamide resins, polyester resins, and polyvinyl acetal resins such as polyvinyl butyral, polyvinyl formal and polyvinyl acetoacetal. Of the above resins, cellulose resins, vinyl resins, acrylic resins, polyurethane resins and polyester resins are preferred in view of heat resistance and transferability of dye.

In the present invention, transfer of the dye or the dye layer to an image-receiving sheet is attained in accordance with the mechanisms of both sublimation and fusion.

The dye layer of the first embodiment of the invention is provided on one surface of the resistor layer in the following manner:

The above-described dye and binder, and some additives such as a releasing agent are dissolved in a proper organic solvent, or dispersed in an organic solvent or water. The solution or dispersion thus obtained is applied onto one surface of the resistor layer by means of gravure printing, screen printing, or a reverse roller coating using a gravure, and then dried, thereby forming a dye layer.

The thickness of the dye layer is from 0.2 to 5.0 μm, preferably from 0.4 to 2.0 μm. The amount of the heat-transferable dye is from 5 to 90 wt. %, preferably from 10 to 70 wt. %, of the total weight of the dye layer.

In order to obtain a monochromic image, the dye layer is formed by using one of the previously-mentioned dyes. For the purpose of obtaining a full-colored image, the dye layer is prepared by using dyes of cyan, magenta, yellow, and if necessary black colors, respectively selected from the previously-mentioned dyes properly.

Any image-receiving sheet can be used along with the electrothermal transfer sheet according to the first embodiment of the present invention as long as it is receptive to the heat-transferable dye contained in the dye layer of the transfer sheet. Even those materials which are not receptive to the dye, such as paper, metals, glass and synthetic resins can be used as image-receiving sheets if they are provided with a dye-receiving layer (image-receiving layer) on at least one surface of sheets of the above materials.

To conduct electrothermal transfer printing by using the electrothermal transfer sheet of the first embodiment of the invention and the image-receiving sheet in combination, any conventional electroconductive-type printer can be used as a heat-application means.

The electrothermal transfer sheet according to the second embodiment of the present invention has basically the same structure as conventional electrothermal transfer sheets have. Namely, it is composed of a substrate sheet, a dye layer formed on one surface of the substrate, and a resistor layer formed on the other surface of the substrate. However, the electrothermal transfer sheet of the second embodiment of the invention is characterized in that the resistor layer is prepared by subjecting a film comprising (a) an electroconductive material, and (b) a resin composition containing a polymer and a monomer to a crosslinking reaction which is caused by applying ionizing radiation to the film. The amount of the monomer contained in the resin composition is from 10 to 150 parts by weight per 100 parts by weight of the polymer.

Any conventionally known film having proper heat resistance and mechanical strength can be employed as the substrate sheet of the electrothermal transfer sheet of the second embodiment of the present invention. For instance, ordinary paper, various types of processed paper, polyester films such as of polyethyleneterephthalate and polyethylene naphthalate, a polystyrene film, a polypropylene film, a polysulfone film, an aramide film, a polycarbonate film, a polyvinyl alcohol film, a polyphenylene sulfide film, a polyether sulfone film, a polyether etherketone film, and a cellophane film are usable. Of these, a polyester film, in particular, a polyethyleneterephthalate film is preferred. The above-enumerated films can be used either as a continuous film or as a non-continuous film. The thickness of the substrate sheet is from 0.5 to 50 μm, preferably from 3 to 10 μm.

An adhesive layer may be provided one or both surfaces of the substrate sheet, if necessary.

The heat-transferable dyes usable in the dye layer of the electrothermal transfer sheet according to the first embodiment of the invention are also usable in the dye layer of the second embodiment of the invention.

In the second embodiment of the invention, the dye layer is provided on one surface of the substrate sheet in the following manner:

The above-described dye and binder, and some additives such as a releasing agent are dissolved in a proper organic solvent, or dispersed in an organic solvent or water. The solution or dispersion thus obtained is applied onto one surface of the substrate sheet by means of gravure printing, screen printing, or a reverse roller coating using a gravure, and then dried, thereby forming a dye layer.

The thickness of the dye layer is from 0.2 to 5.0 μm, preferably from 0.4 to 2.0 μm. The amount of the heat-transferable dye is from 5 to 90 wt. %, preferably from 10 to 70 wt. %, of the total weight of the dye layer.

In order to obtain a monochromic image, the dye layer is formed by using one of the previously-mentioned dyes. For the purpose of obtaining a full-colored image, the dye layer is prepared by using dyes of cyan, magenta, yellow, and if necessary black colors, respectively selected from the previously-mentioned dyes properly.

The resistor layer, which characterizes the electrothermal transfer sheet of the second embodiment of the invention, is provided on the other surface of the substrate sheet. A film comprising (a) an electroconductive material, and (b) a resin composition containing polymer and monomer is subjected to a crosslinking reaction which is caused by applying ionizing radiation thereto to obtain the resistor layer. The amount of the monomer contained in the resin composition is from 10 to 150 parts by weight per 100 parts by weight of the polymer.

Examples of the polymer contained in the resin composition include resins such as polyester resins, polyacrylate resins, polyvinyl acetate resins, styrene-acrylate resins, polyurethane resins, polyolefin resins, polystyrene resins, polyvinyl chloride resins, polyether resins, polyamide resins, polycarbonate resins, polyethylene resins, polypropylene resins, polyacrylate resins, polyacrylamide resins, and polyvinyl acetal resins such as polyvinyl butyral resins.

The monomers usable in the resin composition of the first embodiment of the invention are also usable in the second embodiment of the invention. These monomers can increase the crosslinking density in the resistor layer, and improve film properties. Therefore, the resulting resistor layer can exhibit high mechanical strength even when heated.

Examples of the monomer preferably usable in the second embodiment of the invention include monomers having two functional groups such as tetraethyleneglycol diacrylate, tetraethyleneglycol dimethacrylate, divinylbenzene and diallyl phthalate, monomers having three functional groups such as triallyl isocyanurate, trimethylolpropane triacrylate and trimethylolpropane trimethacrylate, and monomers having four functional groups such as tetramethylolmethane tetraacrylate, tetramethyl olmethane tetramethacrylate and trimethoxyvinyl silane. In addition to the above monomers, oligomers and macromers containing the above monomers are also usable.

In the second embodiment of the invention, it is preferable to use two or more kinds of monomer selected from the above monomers in combination. In particular, a combination use of a monomer having two or less functional groups (hereinafter referred to as "first monomer") and a monomer having three or more functional groups (hereinafter referred to as "second monomer") is desirable.

Examples of the first monomer include monomers such as methacrylate, acrylate, dimethacrylate, diacrylate, divinylbenzene and diallyl phthalate, derivatives of these monomers, and oligomers and macromers containing these monomers. Of these, the following specific monomers are preferably employed:

(1) Methacrylate

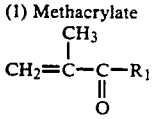

Wherein $R_1$ is $-OH$,
$-(OC_2H_4)_n-OCH_3$ ($0 \leqq n \leqq 15$),
$-OC_nH_{2n+1}$ ($1 \leqq n \leqq 20$),
$-OC_2H_4-OOC-C_2H_4-COOH$,
$-OC_nH_{2n}(OH)$ ($1 \leqq n \leqq 20$),
$-OCH_2-CH(OH)-CH_2Cl$,
$-OC_2H_4(C_nH_{2n+1})_2$ ($1 \leqq n \leqq 20$),

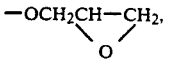

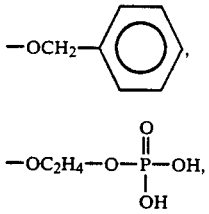

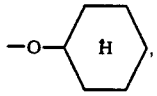

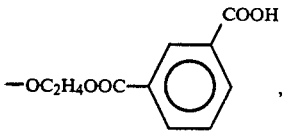

, or

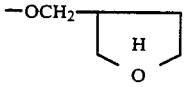

(2) Acrylate

-continued

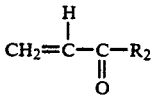

Wherein $R_2$ is
$-OC_nH_{2n+1}$ ($1 \leqq n \leqq 20$),
$-(OC_2H_4)_n-OC_mH_{2m+1}$ ($1 \leqq n \leqq 20$), ($1 \leqq m \leqq 20$),
$-OC_2H_4-OOC-C_2H_4-COOH$,
$-O-(CH_2CHCH_3O)_2-CH_3$
$-OC_nH_{2n}(OH)$ ($1 \leqq n \leqq 20$),
$-(OC_2H_4)_n-OCH_2CH_2H_5-C_4H_9$ ($1 \leqq n \leqq 15$),
$-O-(C_nH_{2n}COO)_m-H$ ($1 \leqq n \leqq 15$), ($1 \leqq m \leqq 10$),

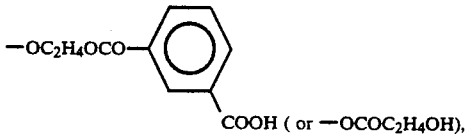

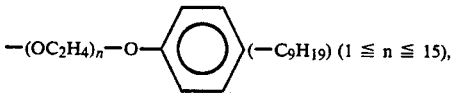

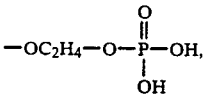

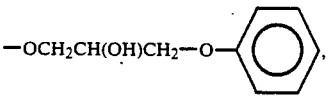

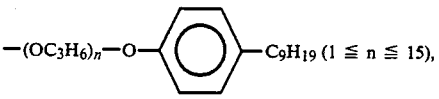

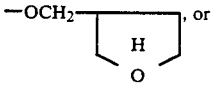

, or

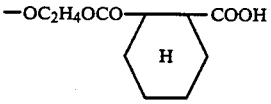

(3) Dimethacrylate

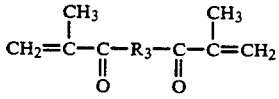

Wherein $R_3$ is
$-O-(C_2H_4)_n-$ ($1 \leqq n \leqq 10$),
$-O-(C_nH_{2n})-O-$ ($1 \leqq n \leqq 5$),
$-OCH_2CH(OH)CH_2O-$,

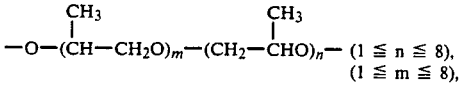

-continued

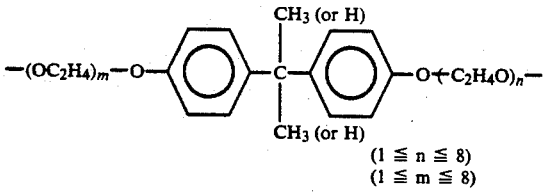

(4) Diacrylate

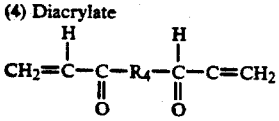

Wherein $R_4$ is the same as the above $R_3$, or

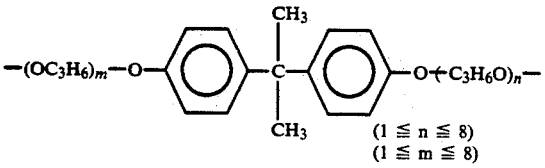

Examples of the second monomer for use in the first embodiment of the invention include monomers such as trimethacrylate, triacrylate, trialiyl isocyanurate, tetraacrylate, pentaacrylate and hexaacrylate, derivatives of these monomers, and oligomers and macromers containing these monomers. Of these, and following specific monomers are preferably employed:

(1) Trimethacrylate

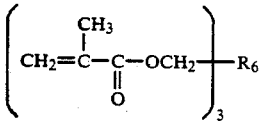

wherein $R_6$ is $-CCH_2CH_3$, (2) Triacrylate

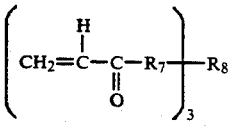

wherein $R_7$ is $-O-CH_2-$,
$-(OC_2H_4)_2-OCH_2-$,
$-(OC_3H_6)_n-OCH_2-$ ($1 \leqq n \leqq 20$),
$-OC_2H_4-$, or
$-O-(CH_2)_n-OCOC_2H_4-$ ($1 \leqq n \leqq 20$), $R_8$ is $-CCH_2CH_3$,
$-CCH_2OH$, or

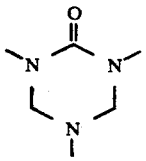

(3) Triallyl isocyanurate

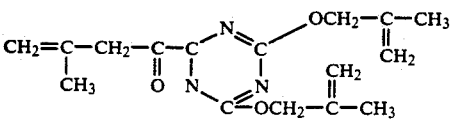

(4) Tetraacrylate

-continued

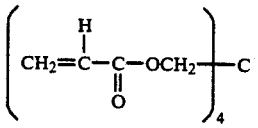

(5) Pentaacrylate

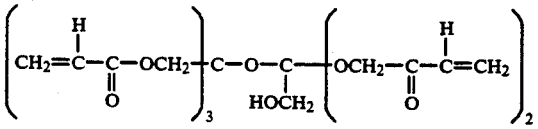

(6) Hexaacrylate

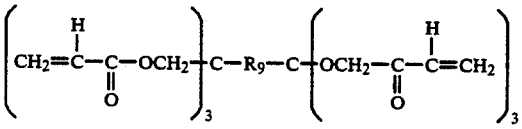

wherein $R_9$ is $-O-$ or $-CH_2O-CH_2-$

The total amount of the above monomers is from 10 to 150 parts by weight, preferably from 40 to 130 parts by weight, per 100 parts by weight of the polymer. In the case where the amount of the monomer contained in the resin composition is less than 10 parts by weight per 100 parts by weight of the polymer, the resulting resistor layer as low heat resistance and exhibits low mechanical strength when heated. As a result, the resistor layer is thermally fused to stick to an electrode head, or is scraped away when printing is carried out, resulting in a short circuit. When the amount of the monomer is more than 150 parts by weight, the resistor layer has a high crosslinking density and high heat resistance, and exhibits high mechanical strength even when heated. However, the resistor layer is to have a rough surface, so that it tends to crumple when printing is carried out.

In the second embodiment of the invention, as described above, it is preferable to use the first monomer having two or less functional groups, and the second monomer having three or more functional groups in combination. In this case, the amount of the first monomer is from 20 to 80 wt. %, preferably from 40 to 70 wt. %, of the total amount of the first and second monomers, while the amount of the second monomer is from 80 to 20 wt. %, preferably from 30 to 60 wt. %, of the total amount of the first and second monomers. When the amount of the first monomer is more than 80 wt. % of the total amount of the monomers, the resistor layer has low heat resistance, and exhibits low mechanical strength when heated. As a result, the resistor layer tends to fuse and to stick to an electrode head when printing is carried out. When the amount of the second monomer is more than 80 wt. %, the resistor layer has high heat resistance and good film properties, and exhibits high mechanical strength even when heated. However, sufficiently high adhesion cannot be obtained between the resistor layer and the substrate sheet. Moreover, the resistor layer is to have a rough surface.

Further, in order to improve heat resistance and film properties, it is preferable to add a curing agent which is crosslinkable upon heat with functional groups of polymeric binder of the resistor layer such as hydroxyl groups, amino groups, epoxy groups or vinyl groups and/or curing catalyst such as polyisocyanate, diamine, titanium chelate, platinum catalyst, tin catalyst or amine catalyst.

In summary, when the first monomer and the second monomer are used in the above-described proportion, the resistor layer has high heat resistance and good film properties. In addition, the surface of the resistor layer is not scraped away when printing is carried out, and sufficiently high adhesion can also be obtained between the resistor layer and the substrate sheet. The electrothermal transfer sheet of the second embodiment of the present invention can thus produce an image having high quality.

Metal powder or a metal oxide may be used as the electroconductive material to be contained in the film for forming the resistor layer. However, carbon black such as furnace black, acetylene black, ketene black, channel black or thermal black is preferably used as the electroconductive material in the second embodiment of the invention.

When a small amount of the electroconductive material is incorporated into the film for forming the resistor layer, the resistor layer cannot have sufficient electroconductivity. On the other hand, when an excessively large amount of the electroconductive material is incorporated, the relative amount of the resin composition contained in the film becomes small, and the film properties of the resistor layer deteriorate. As a result, sufficiently high adhesion between the resistor layer and the substrate sheet cannot be obtained, and scum tends to stick to an electrode head.

When all the above matters are taken into consideration, it is preferable that the amount of the electroconductive material be 300 parts by weight or less, preferably from 40 to 200 parts by weight, per 100 parts by weight of the resin composition containing the monomers.

The resistor layer of the second embodiment of the invention is formed on one surface of the substrate sheet in accordance with the following manner:

A mixture of the above-described polymer, monomers and carbon black as the electroconductive material, and other auxiliary materials are dispersed and kneaded by a sand mill, a kneader having three rollers, or a kneader of any other type, with, if necessary, a proper organic solvent as a diluent. The resulting ink-like mixture is coated onto the surface of the substrate sheet by a proper method, and then dried. The film thus obtained is then hardened by applying ionizing radiation thereto to form cross-linkage therein. The resistor layer can thus be formed on the substrate sheet. In the above, if the monomer can act as a solvent, it is not necessary to use any organic solvent as a diluent.

An ultraviolet ray or an electron beam is usable as the ionizing radiation. In the case where an ultraviolet ray, which may be obtained by any known ultraviolet-generating apparatus, is used for hardening the film, it is preferable to add proper additives, such as a photosensitizer, a polymerization initiator and a radical generator, to the mixture of the polymer, monomer and electroconductive material in advance. When an electron beam, which may be obtained by any known electron-beam-generator, is employed, it is not necessary to add the above-mentioned additives to the mixture for forming the resistor layer. An electron beam is more desirable than an ultraviolet ray because permeability of an electron beam is higher than that of an ultraviolet ray.

The thickness of the resistor layer of the second embodiment of the invention is generally from 1 to 10 μm.

The resistor layer may further comprise a slippery agent. Such a resistor layer has improved smoothening properties.

Furthermore, it is preferable that the resistor layer have a surface resistance of from 500 Ω/58 to 5 kΩ/□.

Any image-receiving sheet can be used along with the electrothermal transfer sheet of the second embodiment of the invention as long as it is receptive to the heat-transferable dye contained in the dye layer of the transfer sheet. Even those materials which are not receptive to the dye, such as paper, metals, glass and synthetic resins can be used as image-receiving sheets if they are provided with a dye-receiving layer (image-receiving layer) on at least one surface of sheets of the above materials.

To conduct electroconductive thermal transfer printing by using the electrothermal transfer sheet of the second embodiment of the invention and the image-receiving sheet in combination, any conventional electroconductive-type printer can be used as a heat application means.

This invention will now be explained more specifically referring to Examples and Comparative Examples. However, the following Examples should not be construed as limiting the present invention. Throughout the Examples and Comparative Examples, quantities expressed in "parts" is "parts by weight".

EXAMPLE A1

A composition for forming a resistor sheet, having the following formulation, was kneaded while heating, and the resulting mixture was processed into a film by means of a T-die method. An electron beam of 175 eV and 5 Mrad was then applied to the film by a low-energy-electron-beam irradiator of an electron curtain type, manufactured by ESI Corp., to harden the film, thereby obtaining a resistor sheet having a thickness of 15 μm.

| Formulation of Composition for Forming Resistor Sheet: | |
|---|---|
| Polyamide resin (Trademark "Barsamide" manufactured by Henkel Hakusui K.K.) | 100 parts |
| Acrylate monomer having two functional groups (Trademark "Aronix M-210" manufactured by Toa Gosei Chemical Industries Co., Ltd.) | 50 parts |
| Acrylate monomer having six functional groups (Trademark "Aronix M-400" manufactured by Toa Gosei Chemical Industries Co., Ltd.) | 40 parts |
| Carbon black (Trademark "#3750" manufactured by Mitsubishi Chemical Industries, Ltd.) | 90 parts |

An ink composition having the following formulation was coated onto one surface of the above-obtained resistor layer in an amount of 1.0 g/m$^2$ on dry basis by means of gravure printing, and then dried to form a dye layer.

Thus, an electrothermal transfer sheet according to the present invention was obtained in a state of continuous film.

| Formulation of Ink Composition: | |
|---|---|
| C.I. Solvent Blue 22 | 5.50 parts |
| Acetoacetal resin | 3.00 parts |
| Methyl ethyl ketone | 22.54 parts |

-continued

| Formulation of Ink Composition: | |
|---|---|
| Toluene | 68.18 parts |

EXAMPLE A2

The procedure in Example A1 was repeated except that the composition for forming the resistor sheet used in Example A1 was replaced by a composition having the following formulation, thereby obtaining an electrothermal transfer sheet according to the present invention.

| Formulation of Composition for Forming Resistor Sheet: | |
|---|---|
| Polyvinyl acetate resin (Trademark "S-Neel E5" manufactured by Sekisui Chemical Co., Ltd.) | 100 parts |
| Acrylate monomer having two functional groups (Trademark "Aronix M-210" manufactured by Toa Gosei Chemical Industries Co., Ltd.) | 30 parts |
| Acrylate monomer having three functional groups (Trademark "Aronix M-305" manufactured by Toa Gosei Chemical Industries Co., Ltd.) | 60 parts |
| Carbon black (Trademark "HS-500" manufactured by Asahi Carbon Co., Ltd.) | 60 parts |

EXAMPLE A3

The procedure in Example A1 was repeated except that the composition for forming the resistor sheet used in Example A1 was replaced by a composition having the following formulation, thereby obtaining an electrothermal transfer sheet according to the present invention.

| Formulation of Composition for Forming Resistor Sheet: | |
|---|---|
| Polyamide resin (Trademark "Barsamide 744" manufactured by Henkel Hakusui K.K.) | 100 parts |
| Acrylate monomer having two functional groups (Trademark "Aronix M-205" manufactured by Toa Gosei Chemical Industries Co., Ltd.) | 40 parts |
| Acrylate monomer having three functional groups (Trademark "Aronix M-315" manufactured by Toa Gosei Chemical Industries Co., Ltd.) | 40 parts |
| Carbon black (Trademark "HS-500" manufactured by Asahi Carbon Co., Ltd.) | 100 parts |

EXAMPLE A4

The procedure in Example A1 was repeated except that the composition for forming the resistor sheet used in Example A1 was replaced by a composition having the following formulation, thereby obtaining an electrothermal transfer sheet according to the present invention.

| Formulation of Composition for Forming Resistor Sheet: | |
|---|---|
| Polyvinyl acetate resin (Trademark "S-Neel E5" manufactured by Sekisui Chemical Co., Ltd.) | 100 parts |
| Acrylate monomer having four functional groups (Trademark "A-TMMT" manufactured by Shin-Nakamura Kagaku Co., Ltd.) | 70 parts |

-continued

| Formulation of Composition for Forming Resistor Sheet: | |
|---|---|
| Carbon black (Trademark "HS-500" manufactured by Asahi Carbon Co., Ltd.) | 100 parts |

COMPARATIVE EXAMPLE A1

The procedure in Example A1 was repeated except that the composition for forming the resistor sheet used in Example A1 was replaced by a composition having the following formulation, thereby obtaining a comparative electrothermal transfer sheet.

| Formulation of Composition for Forming Resistor Sheet: | |
|---|---|
| Polyvinyl acetate resin (Trademark "S-Neel E5" manufactured by Sekisui Chemical Co., Ltd.) | 100 parts |
| Acrylate monomer having six functional groups (Trademark "Aronix M-400" manufactured by Toa Gosei Chemical Industry Co., Ltd.) | 9 parts |
| Carbon black (Trademark "#3750" manufactured by Mitsubishi Chemical Industries, Ltd.) | 100 parts |

COMPARATIVE EXAMPLE A2

The procedure in Example A1 was repeated except that the composition for forming the resistor sheet used in Example A1 was replaced by a composition having the following formulation, thereby obtaining a comparative electrothermal transfer sheet.

| Formulation of Composition for Forming Resistor Sheet: | |
|---|---|
| Polyamide resin (Trademark "Barsamide 744" manufactured by Henkel Hakusui K.K.) | 100 parts |
| Acrylate monomer having two functional groups (Trademark "Aronix M-210" manufactured by Toa Gosei Chemical Industry Co., Ltd.) | 160 parts |
| Carbon black (Trademark "HS-500" manufactured by Asahi Carbon Co, Ltd.) | 80 parts |

EVALUATION A

1. Preparation of Image-Receiving Sheet

A coating liquid for forming an image-receiving layer, having the following formulation, was coated onto one surface of a substrate sheet, a synthetic paper, Trademark "Yupo FPG 150" manufactured by Oji-Yuka Synthetic Paper Co., Ltd., in an amount of 4.5 g/m$^2$ on dry basis, and then dried at 80° C. for ten minutes, whereby an image-receiving sheet was obtained.

| Formulation of Coating Liquid for Forming Image-Receiving Layer: | |
|---|---|
| Polyester resins (Trademark "Vylon 600" manufactured by Toyobo Co., Ltd.) | 4.0 parts |
| Vinyl chloride - vinyl acetate copolymer (Trademark "Denka #1000A" manufactured by Denki Kagaku Kogyo K.K.) | 6.0 parts |
| Amino-modified silicone oil (Trademark "X-22-3050C" manufactured by Shin-Etsu Chemical Co., Ltd.) | 0.2 parts |
| Epoxy-modified silicone oil (Trademark "X-22-3000E" manufactured by Shin-Etsu Chemical Co., Ltd.) | 0.2 parts |
| Methyl ethyl ketone | 44.8 parts |

-continued

| Formulation of Coating Liquid for Forming Image-Receiving Layer: | |
|---|---|
| Toluene | 44.8 parts |

2. Thermal Printing Test

The electrothermal transfer sheets according to the present invention obtained in Examples A1 to A4 and the comparative electrothermal transfer sheets obtained in Comparative Examples A1 and A2 were subjected to the following thermal printing test.

Each electrothermal transfer sheet was superposed on the above-prepared image-receiving sheet so that the dye layer faced the image-receiving layer. By using an electrothermal transfer printer, an image was then printed in the image-receiving sheet under the following conditions:

| | |
|---|---|
| Pulse width: | 1.5 ms |
| Recording cycle: | 7.5 ms/line |
| Recording energy: | 3.0 J/cm$^2$ |

The image thus obtained was visually observed to evaluate the quality of image. The evaluation standard is as follows:

: Excellent

Δ: Good x: Poor

The results are shown in Table 1.

The mechanical strength of each electrothermal transfer sheet was also evaluated in terms of flexibility and breaking thereof during the above printing test. The evaluation standard is as follows:

: Excellent

Δ: Good x: Poor

The results are shown in Table 1.

3. Heat Resistance

Heat resistance of each electrothermal transfer sheet was evaluated in the following manner:

Two electrothermal transfer sheets (the same ones) were superposed with their resistor layers faced, and were pressed while heating by a heat sealer manufactured by Toyo Seiki Seisaku-Sho, Ltd. under the following conditions:

| | |
|---|---|
| Temperature: | 250° C. |
| Pressure: | 2 kg/cm$^2$ |
| Pressing time: | 5 seconds |

The resistor layers were visually observed whether or not they were thermally fused and stuck to each other. The evaluation standard is as follows:

: no sticking was observed

Δ: sticking was slightly observed x: considerable sticking was observed

The results are shown in Table 1.

4. Total Evaluation

Each electrothermal transfer sheet was evaluated totally. The evaluation standard is as follows:

◎: excellent in heat resistance and mechanical strength, observed no sticking between resistor layers, and obtained a high quality image : excellent in coating state, observed no sticking and no adhesion of printing dust, but slight wrinkle at high density portion Δ: good in heat resistance, poor in flexibility, could not be attained close contact between electrothermal transfer sheet and image-receiving sheet, and obtained an uneven image x: poor in heat resistance, broken during printing, and thermally fused and stuck to an electrode head The results are shown in Table 1.

TABLE 1

| | Heat Resistance | Mechanical Strength | Quality of Image | Total Evaluation |
|---|---|---|---|---|
| Example A1 | ○ | ○ | ○ | ◎ |
| Example A2 | ○ | ○ | ○ | ◎ |
| Example A3 | ○ | ○ | ○ | ◎ |
| Example A4 | ○ | Δ | ○ | ○ |
| Comp. Ex. A1 | ○ | Δ | Δ | Δ |
| Comp. Ex. A2 | X | X | X | X |

The above data clearly demonstrate that the electrothermal transfer sheets according to the present invention have high heat resistance, and can exhibit high mechanical strength even when heated. Moreover, the resistor layers of the transfer sheets do not thermally fuse, and do not stick to an electrode head when printing is carried out. Therefore, an electrode head can smoothly run on the transfer sheets, and a high-quality image can thus be obtained.

EXAMPLE B1

A composition for forming a resistor layer, having the following formulation, was placed in a ball mill pot, and was thoroughly dispersed, whereby an ink-like mixture was obtained.

| Formulation of Composition for Forming Resistor Layer: | |
|---|---|
| Polyester resin (Trademark "Vylon 200" manufactured by Toyobo Co., Ltd.) | 100 parts |
| Acrylate monomer having two functional groups (Trademark "Aronix M-210" manufactured by Toa Gosei Chemical Industry Co., Ltd.) | 40 parts |
| Acrylate monomer having six functional groups (Trademark "Aronix M-400" manufactured by Toa Gosei Chemical Industry Co., Ltd.) | 50 parts |
| Carbon black (Trademark "#3750" manufactured by Mitsubishi Chemical Industries, Ltd.) | 80 parts |
| Toluene/Methyl ethyl ketone (1:1) | 200 parts |

An adhesive layer containing a polyurethane resin and polyisocyanate, having a thickness of 0.5 μm, was provided on both surfaces of a polyethyleneterephthalate film having a thickness of 6 μm, which served as a substrate sheet.

The above-obtained ink-like mixture was coated onto the surface of one of the above-formed two adhesive layers by a wire bar, and then dried to form a film having a thickness of 5 μm. Thereafter, the film was hardened by applying an electron beam of 175 Kev and 5 Mrad thereto by a low-energy-electron-beam irradiator of an electron curtain type (manufactured by ESI Corp.). Thus, a resistor layer hardened by a crosslinking reaction was formed on the adhesive layer.

An ink composition for forming a dye layer, having the following formulation, was coated onto the surface of the other adhesive layer in an amount of 1.0 g/m$^2$ on dry basis by means of gravure printing, and then dried.

Thus, an electrothermal transfer sheet according to the present invention was obtained in a state of continuous film.

| Formulation of Dye Composition for Forming Dye Layer: | |
|---|---|
| C.I. Solvent blue | 5.50 parts |
| Acetoacetal resin | 3.00 parts |
| Methyl ethyl ketone | 22.54 parts |
| Toluene | 68.18 parts |

EXAMPLE B2

The procedure in Example B1 was repeated except that the composition for forming the resistor layer used in Example B1 was replaced by a composition having the following formulation, thereby obtaining an electrothermal transfer sheet according to the present invention.

| Formulation of Composition for Forming Resistor Layer: | |
|---|---|
| Polyurethane resin (Trademark "Pandex T-5000" manufactured by Dainippon Ink & Chemicals, Inc.) | 10 parts |
| Acrylate monomer having two functional groups (Trademark "Aronix M-210" manufactured by Toa Gosei Chemical Industry Co., Ltd.) | 6 parts |
| Acrylate monomer having three functional groups (Trademark "Aronix M-305" manufactured by Toa Gosei Chemical Industry Co., Ltd.) | 3 parts |
| Carbon black (Trademark "HS-500" manufactured by Asahi Carbon Co., Ltd.) | 14 parts |
| Toluene/Methyl ethyl ketone (1:1) | 140 parts |

EXAMPLES B3

The procedure in Example B1 was repeated except that the composition for forming the resistor layer used in Example B1 was replaced by a composition having the following formulation, thereby obtaining an electrothermal transfer sheet according to the present invention.

| Formulation of Composition for Forming Resistor Layer: | |
|---|---|
| Polyester resin (Trademark "Vylon 600" manufactured by Toyobo Co., Ltd.) | 10 parts |
| Acrylate monomer having two functional groups (Trademark "Aronix M-205" manufactured by Toa Gosei Chemical Industry Co., Ltd.) | 5 parts |
| Acrylate monomer having three functional groups (Trademark "Aronix M-315" manufactured by Toa Gosei Chemical Industry Co., Ltd.) | 7 parts |
| Carbon black (Trademark "HS-500" manufactured by Asahi Carbon Co., Ltd.) | 14 parts |
| Toluene/Methyl ethyl ketone (1:1) | 150 parts |

EXAMPLE B4

The procedure in Example B1 was repeated except that the composition for forming the resistor layer used in Example B1 was replaced by a composition having the following formulation, thereby obtaining an electrothermal transfer sheet according to the present invention.

| Formulation of Composition for Forming Resistor Layer: | |
|---|---|
| Polyurethane resin (Trademark "Pandex T-5670" manufactured by Dainippon Ink & Chemical Co., Ltd.) | 10 parts |
| Acrylate monomer having four functional groups (Trademark "A-TMMT" manufactured by Shin-Nakamura Kagaku K.K.) | 7 parts |
| Carbon black (Trademark "#3950" manufactured by Mitsubishi Chemical Industries, Ltd.) | 12 parts |
| Toluene/Methyl ethyl ketone (1:1) | 140 parts |

EXAMPLE B5

The procedure in Example B1 was repeated except that the composition for forming the resistor layer used in Example B1 was replaced by a composition having the following formulation, thereby obtaining an electrothermal transfer sheet according to the present invention.

| Formulation of Composition for Forming Resistor Layer: | |
|---|---|
| Polyvinyl acetoacetal resin (Trademark "Eslec KS-1" manufactured by Sekisui Kagaku Co., Ltd.) | 10 parts |
| Acrylate monomer having two functional groups (Trademark manufactured by Nippon Kayaku K.K.) | 3 parts |
| Acrylate monomer having five functional groups (Trademark "KAYARAD D-310" manufactured by Nippon Kayaku K.K.) | 7 parts |
| Carbon black (Trademark "HS-500" manufactured by Asahi Carbon Co., Ltd.) | 14 parts |
| Toluene/Methyl ethyl ketone (1:1) | 140 parts |

EXAMPLE B6

The procedure in Example B1 was repeated except that the composition for forming the resistor layer used in Example B1 was replaced by a composition having the following formulation, thereby obtaining an electrothermal transfer sheet according to the present invention.

| Formulation of Composition for Forming Resistor Layer: | |
|---|---|
| Polyvinyl acetoacetal resin (Trademark "Eslec KS-5" manufactured by Sekisui Kagaku Co., Ltd.) | 10 parts |
| Acrylate monomer having six functional groups (Trademark "Aronix M-400" manufactured by Toa Gosei Chemical Industry Co., Ltd.) | 5 parts |
| Polyisocyanate (Trademark "Coronate EH" manufactured by Nippon Polyurethane K.K.) | 2 parts |
| Conductive potassium titanate (Trademark "Dentol BK-300" manufactured by Otsuka Kagaku K.K.) | 14 parts |
| Toluene/Methyl ethyl ketone (1:1) | 150 parts |

COMPARATIVE EXAMPLE B1

The procedure in Example B1 was repeated except that the composition for forming the resistor layer used in Example B1 was replaced by a composition having the following formulation, thereby obtaining a comparative electrothermal transfer sheet.

| Formulation of Composition for Forming Resistor Layer: | |
|---|---|
| Polyurethane resin (Trademark "Pandex T-5000" manufactured by Dainippon Ink & Chemicals, Inc.) | 10 parts |
| Acrylate monomer having six functional groups (Trademark "Aronix M-400" manufactured by Toa Gosei Chemical Industry Co., Ltd.) | 0.9 parts |
| Carbon black (Trademark "#3750" manufactured by Mitsubishi Chemical Industries, Ltd.) | 10 parts |
| Toluene/Methyl ethyl ketone (1:1) | 90 parts |

COMPARATIVE EXAMPLE B2

The procedure in Example B1 was repeated except that the composition for forming the resistor layer used in Example B1 was replaced by a composition having the following formulation, thereby obtaining a comparative electrothermal transfer sheet.

| Formulation of Composition for Forming Resistor Layer: | |
|---|---|
| Polyester resin (Trademark "Vylon 200" manufactured by Toyobo Co., Ltd.) | 10 parts |
| Acrylate monomer having two functional groups (Trademark "Aronix M-210" manufactured by Toa Gosei Chemical Industry Co., Ltd.) | 16 parts |
| Carbon black (Trademark "HS-500" manufactured by Asahi Carbon Co., Ltd.) | 10 parts |
| Toluene/Methyl ethyl ketone (1:1) | 150 parts |

EVALUATION B

1. Preparation of Image-Receiving Sheet

A coating liquid for forming an image-receiving layer, having the following formulation, was coated onto one surface of a substrate sheet, a synthetic paper, Trademark "Yupo FPG 150" manufactured by Oji-Yuka Synthetic Paper Co., Ltd., in an amount of 4.5 g/m$^2$ on dry basis, and then dried at 80° C. for ten minutes, whereby an image-receiving sheet was obtained.

| Formulation of Coating Liquid for Forming Image-Receiving Layer: | |
|---|---|
| Polyester resin (Trademark "Vylon 600" manufactured by Toyobo Co., Ltd.) | 4.0 parts |
| Vinyl chloride - vinyl acetate copolymer (Trademark "Denka #1000A" manufactured by Denki Kagaku Kogyo K.K.) | 6.0 parts |
| Amino-modified silicone oil (Trademark "X-22-3050C" manufactured by Shin-Etsu Chemical Co., Ltd.) | 0.2 parts |
| Epoxy-modified silicone oil (Trademark "X-22-3000E" manufactured by Shin-Etsu Chemical Co., Ltd.) | 0.2 parts |
| Methyl ethyl ketone | 44.8 parts |
| Toluene | 44.8 parts |

2. Thermal Printing Test

The electrothermal transfer sheets according to the present invention obtained in Examples B1 to B4 and the comparative electrothermal transfer sheets obtained in Comparative Examples B1 and B2 were subjected to the following thermal printing test.

Each electrothermal transfer sheet was superposed on the above-prepared image-receiving sheet so that the dye layer faced the image-receiving layer. By using an electrothermal transfer printer, an image was then printed in the image-receiving sheet under the following conditions:

| | |
|---|---|
| Pulse width: | 1.5 ms |
| Recording cycle: | 7.5 ms/line |
| Recording energy: | 3.0 J/cm$^2$ |

The image thus obtained was visually observed to evaluate the quality of image. The evaluation standard is as follows:

: Excellent
Δ: Good
x: Poor

The results are shown in Table 2.

After the above printing using each electrothermal transfer sheet, the electrode head was observed by a microscope to confirm whether or not it was deposited with scum of the resistor layer. The evaluation standard is as follows:

: no scum was deposited
Δ: scum was slightly deposited
x: considerable amount of scum was deposited The result are shown in Table 2.

3. Heat Resistance

Heat resistance of each electrothermal transfer sheet was evaluated in the following manner:

Two electrothermal transfer sheets (the same ones) were superposed with their resistor layers faced, and were pressed while heating by a heat sealer manufactured by toyo Seiki Seisaku-Sho, Ltd. under the following conditions:

| | |
|---|---|
| Temperature: | 250° C. |
| Pressure: | 2 kg/cm$^2$ |
| Pressing time: | 5 seconds |

The resistor layers were visually observed whether or not they were fused and stuck to each other. The evaluation standard is as follows:

: no sticking was observed
Δ: sticking was slightly observed
x: sticking was considerably observed.

The results are shown in Table 2.

4. Adhesion between Resistor Layer and Substrate Sheet

An adhesive tape, Trademark "Mending Tape" manufactured by Sumitomo 3M Limited, was brought into pressure contact with the resistor layer of each electrothermal transfer sheet with a contact pressure of 1 kg/cm$^2$. Thereafter, the adhesive Tape was peeled off the resistor layer in the direction of 180 degrees with the electrothermal transfer sheet fixed. The adhesion between the resistor layer and the substrate sheet was thus evaluated. The evaluation standard is as follows:

: High adhesion
Δ: Moderate adhesion
x: Low adhesion

The results are shown in Table 2.

5. Total Evaluation

Each electrothermal transfer sheet was evaluated totally. The evaluation standard is as follows:

502 : excellent in heat resistance and film properties, observed no sticking between resistor layers, and obtained a high-quality image : excellent in coating state, observed no sticking and no adhesion of printing dust, but slight wrinkle at high density portion Δ: obtained a partially uneven image due to rough surface of resistor layer x: deposited scum on electrode head due to friction caused between resistor layer and electrode head, poor in heat resistance, thermally fused and stuck to electrode head due to crumpling of transfer sheet The results are shown in Table 2.

TABLE 2

| | I | II | III | IV | V |
|---|---|---|---|---|---|
| Example B1 | ○ | ○ | ○ | ○ | ◎ |
| Example B2 | ○ | ○ | ○ | ○ | ◎ |
| Example B3 | ○ | ○ | ○ | ○ | ◎ |
| Example B4 | Δ | ○ | ○ | ○ | ○ |
| Example B5 | ◎ | ◎ | ○ | ○ | ◎ |
| Example B6 | ◎ | ◎ | ○ | ○ | ◎ |
| Comp. Ex. B1 | Δ | ○ | Δ | X | Δ |
| Comp. Ex. B2 | Δ | X | X | X | X |

[NOTE] In Table 2,
"I": adhesion between resistor layer and substrate sheet
"II": heat resistance of resistor layer;
"III": deposition of scum on electrode head;
"IV": quality of image obtained; and
"V": total evaluation.

The data shown in Table 2 clearly demonstrate that the electrothermal transfer sheets according to the present invention can overcome the shortcomings of the prior art. The resistor layers of the electrothermal transfer sheets of the present invention are not thermally used to stick to an electrode head when printing is carried out, so that the electrode head can run smoothly on the electrothermal transfer sheets. As a result, a high-quality image can be obtained.

What is claimed is:

1. An electrothermal transfer sheet comprising
(i) a resistor sheet, and
(ii) a dye layer formed on one surface of said resistor sheet, said dye layer comprising a heat-transferable dye and a binder;
said resistor sheet being prepared by applying ionizing radiation to a film for said resistor sheet thereby hardening said film by a crosslinking reaction, said film comprising (a) an electroconductive material, and (b) a resin composition comprising a polymer and a monomer, the amount of said monomer being from 70 to 120 parts by weight per 100 parts by weight of said polymer, said monomer comprising a mixture of at least a first and a second monomer, said first monomer having two or less functional groups and said second monomer having three or more functional groups, the amount of said first monomer being from 20 to 80% by weight of the total amount of said first monomer and said second monomer, and the amount of said second monomer being from 80 to 20% by weight of the total amountof said first monomer and said second monomer.

2. The electrothermal transfer sheet according to claim 1, wherein the amount of said first monomer is from 40 to 60 wt. % of the total amount of said first monomer and said second monomer, and the amount of said second monomer is from 30 to 60 wt. % of the total amount of said first monomer and said second monomer.

3. The electrothermal transfer sheet according to claim 1, wherein said first monomer is selected from the group consisting of monomers of methacrylate, acrylate, dimethacrylate, diacrylate, divinylbenzene and diallyl phthalate, and oligomers and macromers containing the same.

4. The electrothermal transfer sheet according to claim 1, wherein said second monomer is selected from the group consisting of monomers of trimethacrylate, triacrylate, triallyl isocyanurate, tetraacrylate, pentaacrylate and hexaacrylate, and oligomers and macromers containing the same.

5. The electrothermal transfer sheet according to claim 1, wherein said resistor layer has a surface resistivity of from 500 Ω/□ to 5 kΩ/□.

6. An electrothermal transfer sheet comprising
(i) a substrate sheet,
(ii) a dye layer formed on one surface of said surface sheet, said dye layer comprising a heat-transferable dye and a binder, and
(iii) a resistor layer formed on the other surface of said substrate sheet,
said resistor layer being prepared by applying ionizing radiation to a film for said resistor layer thereby hardening said film by a crosslinking reaction, said film comprising (a) an electroconductive material, and (b) a resin composition comprising a polymer and a monomer, the amount of said monomer being from 70 to 120 parts by weight per 100 parts by weight of said polymer, said monomer comprising a mixture of at least a first and a second monomer, said first monomer having two or less functional groups and said second monomer having three or more functional groups, the amount of said first monomer being from 20 to 80% by weight of the total amount of said first monomer and said second monomer, and the amount of said second monomer being from 80 to 20% by weight of the total amount of said first monomer and said second monomer.

7. The electrothermal transfer sheet according to claim 6, wherein the amount of said first monomer is from 40 to 70 wt. % of the total amount of said first monomer and said second monomer, and the amount of said second monomer is from 30 to 60 wt. % of the total amount of said first monomer and said second monomer.

8. The electrothermal transfer sheet according to claim 6, wherein said first monomer is selected from the group consisting of monomers of methacrylate, acrylate, dimethacrylate, diacrylate, divinylbenzene and diallyl phthalate, and oligomers and macromers containing the same.

9. The electrothermal transfer sheet according to claim 6, wherein said second monomer is selected from the group consisting of monomers of trimethacrylate, triacrylate, triallyl isocyanurate, tetraacrylate, pentaacrylate and hexaacrylate, and oligomers and macromers containing the same.

10. The electrothermal transfer sheet according to claim 6, wherein said resistor layer has a surface resistivity of from 500 Ω/□ to 5 kΩ/□.

* * * * *